US012800219B2

(12) United States Patent
Byeon et al.

(10) Patent No.: US 12,800,219 B2
(45) Date of Patent: Nov. 17, 2026

(54) EXTERIOR MATERIAL FOR HOME APPLIANCE AND REFRIGERATOR COMPRISING SAME

(71) Applicant: SAMSUNG ELECTRONICS CO., LTD., Suwon-si (KR)

(72) Inventors: Dahyun Byeon, Suwon-si (KR); Yonghwan Kim, Suwon-si (KR); Choongkeon Kim, Suwon-si (KR); Youngdeog Koh, Suwon-si (KR); Kwangjoo Kim, Suwon-si (KR); Seok Rhee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 370 days.

(21) Appl. No.: 18/143,159

(22) Filed: May 4, 2023

(65) Prior Publication Data

US 2024/0011702 A1 Jan. 11, 2024

Related U.S. Application Data

(63) Continuation of application No. PCT/KR2023/005317, filed on Apr. 19, 2023.

(30) Foreign Application Priority Data

Jul. 8, 2022 (KR) ..... 10-2022-0084672
Aug. 18, 2022 (KR) ..... 10-2022-0103504

(51) Int. Cl.
*F25D 23/06* (2006.01)

(52) U.S. Cl.
CPC ..... *F25D 23/066* (2013.01); *F25D 23/062* (2013.01); *F25D 2323/06* (2013.01); *F25D 2400/18* (2013.01)

(58) Field of Classification Search
None
See application file for complete search history.

(56) References Cited

U.S. PATENT DOCUMENTS 10,739,057 B2 * 8/2020 Segawa ..... F25D 17/045
10,760,849 B2 * 9/2020 Jung ..... F25D 23/064
10,808,989 B2 * 10/2020 Yoon ..... F25D 23/063
(Continued)

FOREIGN PATENT DOCUMENTS

EP 0522454 A1 * 1/1993
EP 3 118 343 A1 1/2017
(Continued)

OTHER PUBLICATIONS

International Search Report dated Aug. 3, 2023 in International Patent Application No. PCT/KR2023/005317.
(Continued)

*Primary Examiner* — Hanh V Tran
(74) *Attorney, Agent, or Firm* — STAAS & HALSEY LLP

(57) ABSTRACT

An exterior material for a home appliance and a refrigerator including the same. In accordance with one embodiment, an exterior material for home appliances includes: a steel sheet having a yield strength of between 350 to 410 MPa; a base coating layer arrangeable on the steel sheet; and a clear coating layer arrangeable on the base coating layer. A depth of embossments on a surface of the exterior material may be about 70 to 90 μm.

16 Claims, 7 Drawing Sheets

(56) References Cited

U.S. PATENT DOCUMENTS

| | | | | |
|---|---|---|---|---|
| 11,377,744 | B2 | 7/2022 | Shibao et al. | |
| 2006/0182929 | A1* | 8/2006 | Joerdens | F24C 15/005 428/141 |
| 2020/0032399 | A1* | 1/2020 | Shibao | B32B 15/09 |
| 2021/0388460 | A1* | 12/2021 | Teipel | C21D 6/002 |

FOREIGN PATENT DOCUMENTS

| | | | | |
|---|---|---|---|---|
| EP | 3327097 | B1 * | 9/2020 | C08J 7/0427 |
| JP | 5-65429 | | 3/1993 | |
| JP | 3371096 | | 1/2003 | |
| JP | 2006-346934 | | 12/2006 | |
| JP | 2007-14911 | | 1/2007 | |
| JP | 2011-136566 | | 7/2011 | |
| JP | 2011136566 | A * | 7/2011 | |
| JP | 2011-177621 | | 9/2011 | |
| KR | 10-0700379 | | 3/2007 | |
| KR | 10-2008-0001251 | | 1/2008 | |
| KR | 10-1056943 | | 8/2011 | |
| KR | 20130004167 | U * | 7/2013 | |
| KR | 10-1223866 | | 11/2015 | |
| KR | 10-1870509 | | 6/2018 | |
| KR | 10-2273301 | | 7/2021 | |
| KR | 10-2022-0039412 | | 3/2022 | |
| KR | 10-2022-0142885 | | 10/2022 | |
| WO | WO 2007/148922 | A1 | 12/2007 | |
| WO | WO 2018/160793 | A1 | 9/2018 | |

OTHER PUBLICATIONS

PCT/ISA/237 dated Aug. 3, 2023 in International Patent Application No. PCT/KR2023/005317.

Extended European Search Report dated Aug. 11, 2025 for European Application No. 23835659.6.

* cited by examiner

EXTERIOR MATERIAL FOR HOME APPLIANCE AND REFRIGERATOR COMPRISING SAME

CROSS-REFERENCE TO RELATED APPLICATION

This application is a continuation application, under 35 U.S.C. § 111(a), of international application No. PCT/KR2023/005317, filed on Apr. 19, 2023, which claims priority under 35 U. S. C. § 119 to Korean Patent Application Nos. 10-2022-0084672, filed Jul. 8, 2022, and 10-2022-0103504, filed Aug. 18, 2022, the disclosures of which are incorporated herein by reference in their entirety.

BACKGROUND

1. Field

Embodiments of the present disclosure relate to an exterior material for home appliances and a refrigerator including the same.

2. Description of the Related Art

A refrigerator is a home appliance that stores food in a fresh state by including a body having a storage compartment and a cold air supply device provided to supply cold air to the storage compartment. The body of the refrigerator may include an outermost cabinet, a cavity forming an inner wall, and an insulating material.

For insulation, urethane foaming may be performed on the back of a steel sheet used for the cabinet of the refrigerator. The foaming is necessary for insulation, soundproofing, and sound absorption, but irregular bends are formed on an outer surface of the steel sheet after the foaming.

Also, although thick steel sheets are utilized to reduce the formation of bends, a large amount of raw material is required.

Therefore, there is a need to develop an exterior material that has an improved surface quality by reducing the formation of bends despite utilizing thin steel sheets.

SUMMARY

In accordance with one embodiment, an exterior material to form a home appliance includes: a steel sheet having a yield strength of between 350 to 410 MPa; a base coating layer arrangeable on the steel sheet; and a clear coating layer arrangeable on the base coating layer. Also, a depth of embossments on a surface of the exterior material may be 70 to 90 μm.

In accordance with one embodiment, a method of manufacturing an exterior material for home appliances includes: forming a base coating layer on a steel sheet, the base coating layer including between 2.5 to 4.0 wt % of silica based on an entire weight of the base coating layer; forming a clear coating layer on the base coating layer, the clear coating layer including between 2.0 to 5.0 wt % of beads and silica based on an entire weight of the clear coating layer; and forming embossments on a surface of the exterior material. Also, the embossments may have a depth of 70 to 90 μm.

In accordance with one embodiment, a refrigerator includes: a cabinet arrangeable at an outermost portion of the refrigerator; a cavity configured to form an inner wall of the refrigerator; and urethane between the cabinet and the cavity. The cabinet may include an exterior material for home appliances. The exterior material for home appliances may include: a steel sheet having a yield strength of between 350 to 410 MPa; a base coating layer arrangeable on the steel sheet; and a clear coating layer arrangeable on the base coating layer. Also, a depth of embossments on a surface of the exterior material may be 70 to 90 μm.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
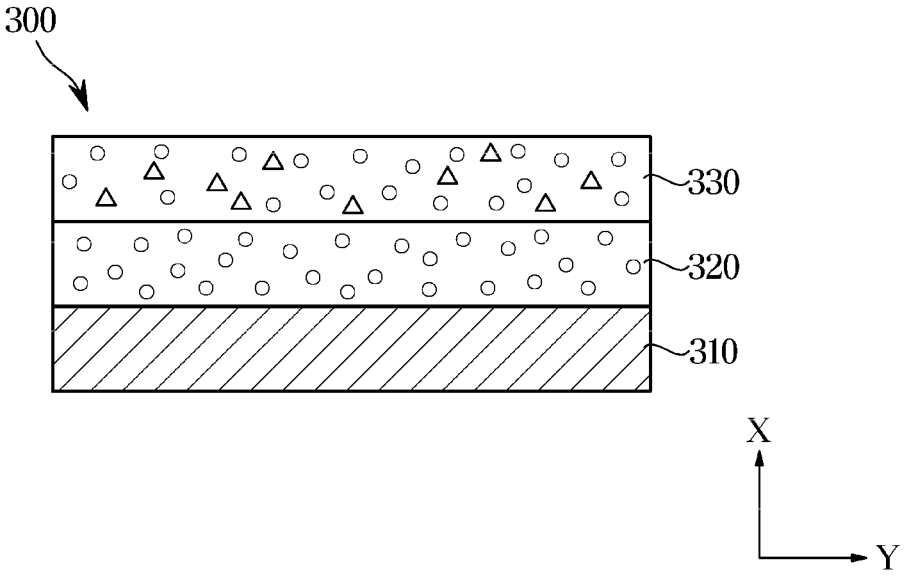
FIG. 1 is a lateral cross-sectional view illustrating a stacking structure of an exterior material for home appliances according to one embodiment.

Hereinafter, embodiments of the present disclosure will be described in detail with reference to the accompanying drawings. The following embodiments are presented to sufficiently convey the spirit of the present disclosure to those of ordinary skill in the art to which the present disclosure pertains. The present disclosure is not limited to the embodiments presented herein and may be embodied in other forms. In the drawings, illustration of parts unrelated to the description may be omitted to clarify the present disclosure, and sizes of components may be somewhat exaggerated to help understanding.

Throughout the specification, when a certain part is described as "including" a certain component, this signifies that the certain part may also include other components rather than excluding other components unless particularly described otherwise.

A singular expression includes a plural expression unless the context clearly indicates otherwise.

Therefore, it is an aspect of the present disclosure to provide an exterior material for home appliances that has an improved surface quality despite a reduced thickness and a refrigerator including the same.

According to one embodiment, by utilizing a steel sheet that utilizes special paint and has an optimized depth of embossments and a high strength, it is possible to provide an exterior material for home appliances that has an improved surface quality despite a small thickness and a refrigerator including the same.

However, advantageous effects that can be achieved by the exterior material for home appliances and a refrigerator including the same according to embodiments are not limited to those mentioned above, and other unmentioned advantageous effects should be clearly understood by those of ordinary skill in the art to which the present disclosure pertains from the description below.

According to one embodiment, an exterior material for home appliances includes: a steel sheet whose yield strength is 350 to 410 MPa; a base coating layer provided on the steel sheet; and a clear coating layer provided on the base coating layer.

FIG. 1 is a lateral cross-sectional view illustrating the stacking structure of the exterior material according to one embodiment.

Referring to FIG. 1, an exterior material 300 for home appliances according to a disclosed embodiment may include a steel sheet 310, a base coating layer 320 provided on the steel sheet 310, and a clear coating layer 330 provided on the base coating layer 320.

The exterior material 300 for home appliances according to one embodiment may be a pre-coated metal (PCM) steel sheet and may be a steel sheet obtained by applying paint on the steel sheet 310 such as an electrolytic galvanized iron (EGI) steel sheet and a hot-dip galvanized iron (GI) steel sheet.

The hot-dip GI steel sheet is a steel sheet obtained by galvanizing a full-hard steel sheet, which is obtained by pickling and rolling a hot-rolled steel sheet, in a molten state through a zinc pot. The hot-dip GI steel sheet enables thicker galvanization than the EGI steel sheet and thus can secure higher corrosion resistance.

The EGI steel sheet is a product obtained by electrolytic galvanization of a cold-rolled steel sheet to improve corrosion resistance, and despite thinner galvanization than the hot-dip GI steel sheet, a thickness of a galvanizing layer is uniform, a surface is aesthetically pleasing, and galvanization is performed at low temperature such that mechanical properties of the cold-rolled steel sheet, which is a base material, are maintained unchanged.

The steel sheet 310 may be a high-strength steel sheet whose yield strength is 350 to 410 MPa. The present disclosure may utilize a steel sheet whose yield strength is about 50% higher compared to the related art in order to minimize surface deformation due to foaming.

In the exterior material 300 for home appliances, a depth of embossments may be 70 to 90 μm.

The depth of embossments relates to visibility of bends. An increase in the depth of embossments may increase a difference between engravings and the embossments and thus increase the visibility of embossed patterns. The high visibility of embossed patterns has an effect of making bends of the surface of the exterior material less visible. Therefore, the visibility of bends may decrease with an increase in the depth of embossed patterns.

However, in a case in which the depth of embossments is too large, a diameter of holes formed in the surface of the exterior material may increase, and an area of the surface of the exterior material may decrease. Accordingly, in the case in which the depth of embossments is too large, utilization of automatic conveying equipment for adsorbing the surface of the exterior material to convey the exterior material may become difficult, and productivity may decrease.

The steel sheet 310 may include 0.08 to 0.18 wt % of carbon based on the entire weight of the steel sheet.

Carbon is an element that plays a key role in improving the strength of steel. An increase in the content of carbon may cause carbon atoms to intrude in between lattices of iron atoms, deform the surroundings, and interfere with a potential shift.

Low carbon content may make it difficult to manufacture a thin steel sheet. However, excessively high carbon content may cause elongation to decrease and make forming difficult. Accordingly, carbon content may be controlled to be 0.08 to 0.18% or controlled to be 0.1 to 0.15%.

The steel sheet 310 may have elongation of 20% or higher. Excessively low elongation may make steel sheet forming difficult and decrease productivity.

The base coating layer 320 may be provided on the steel sheet 310. The base coating layer 320 may include a polyester resin as the main resin and may include a leveling agent, a pigment, and the like. In addition to these components, the base coating layer 320 of the exterior material 300 for home appliances according to the disclosed embodiment may include a silica 324 as a matting agent.

A matting agent is an additive added to reduce the gloss of the exterior material 300 for home appliances. The base coating layer 320 of the exterior material 300 for home appliances according to the disclosed embodiment may include 2.5 to 4.0 wt % of the silica 324 or include 3.5 wt % of the silica 324, based on the entire weight of the base coating layer 320. An acrylic-coated organic silica may be used as the silica 324, but the present disclosure is not limited thereto.

Figure 2:
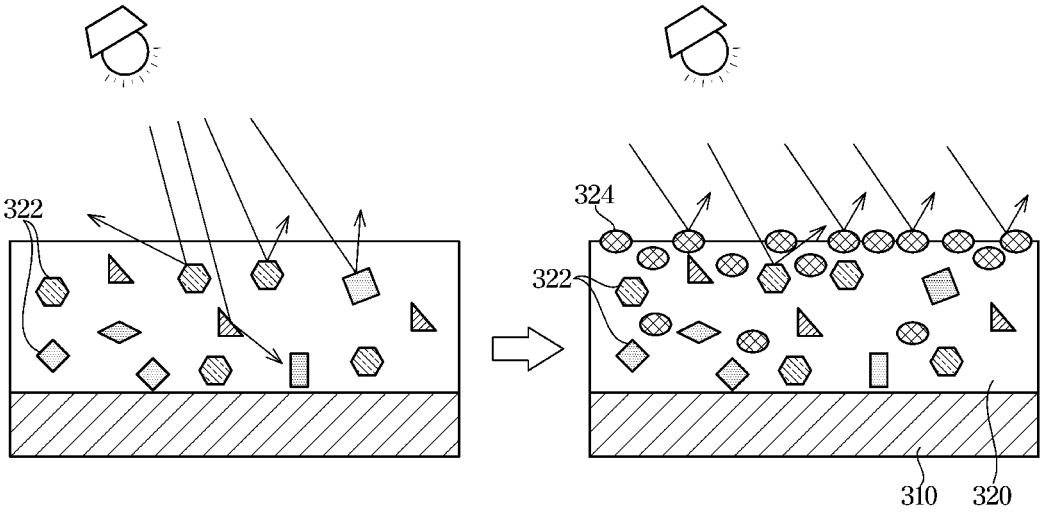
FIGS. 2 and 3 are schematic diagrams illustrating a mechanism of decrease in gloss of a side surface of the exterior material for home appliances according to one embodiment.
Figure 3:
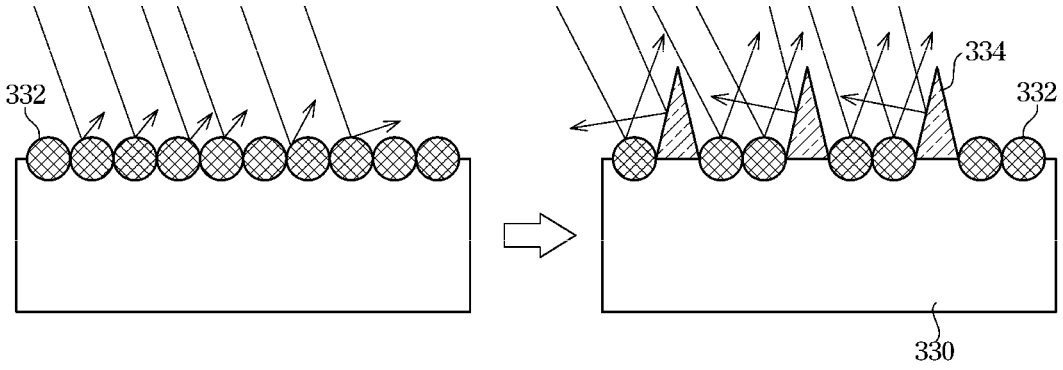

FIGS. 2 and 3 are schematic diagrams illustrating a mechanism of decrease in gloss of a side surface of the steel sheet according to one embodiment.

Referring to FIG. 2, irregular reflection of light incident from the outside occurs due to metallic particles 322 of the pigment included in the base coating layer 320, and thus, gloss of the side surface, that is, gloss at an angle of 85°, increases. An increase in the glossiness of the side surface causes the visibility of bends formed on an outer surface of the exterior material 300 for home appliances to also increase. Accordingly, in the disclosed embodiment, the silica 324 may be added as the matting agent to interfere with the irregular reflection by the metallic particles 322 or the like of the pigment, thus reducing the visibility of gloss at an angle of 85°.

In this way, by the silica 324 being included as the matting agent not only in the clear coating layer 330, which will be described below, but also in the base coating layer 320, the gloss of the side surface of the exterior material 300 for home appliances may be reduced.

The clear coating layer 330 may be provided on the base coating layer 320. The clear coating layer 330 may include a polyester resin as the main resin and may include a leveling agent or the like. In addition to these components, the clear coating layer 330 of the exterior material 300 for home appliances according to the disclosed embodiment may include beads 334 and a silica 332 as a matting agent.

The clear coating layer 330 of the exterior material 300 for home appliances according to the disclosed embodiment may include 2.0 to 5.0 wt % of the beads 334 or include 2.0 wt % of the beads 334, based on the entire weight of the clear coating layer 330. Acrylic beads may be used as the beads 334, but the present disclosure is not limited thereto. Also, the bead 334 may have a size of 20 to 50 μm or have a size of 20 μm.

Meanwhile, the size of a bead refers to the length of the longest cross-sectional axis of the bead.

Hereinafter, special paint used to form the base coating layer 320 and the clear coating layer 330 will be referred to as side-surface reduction paint.

Along with the beads 334 described above, the silica 332 may be included as the matting agent. The silica 332 may be included at 5 wt % based on the entire weight of the clear coating layer 330.

Referring to FIG. 3, in the case in which the acrylic beads 334 having the shape of rough particles are used along with the silica 332 as the matting agent in the clear coating layer 330, irregular reflection of light is maximized, and thus, gloss of the side surface, that is, gloss at an angle of 85°, decreases. Therefore, the visibility of gloss at an angle of 85° can be reduced.

The gloss at 85° of the exterior material 300 for home appliances may be 10 GU or less, 5 GU or less, or 3 GU or less.

A cabinet forming an outer surface of a refrigerator may be made of a PCM steel sheet as described above, and when foaming is performed on the PCM steel sheet for insulation, irregular bends are formed on an outer surface of the steel sheet.

The bends formed on the outer surface of the steel sheet are visible to a user and act as a factor that reduces the aesthetic sense, thus decreasing the marketability.

Accordingly, the disclosed embodiment is directed to providing an exterior material for home appliances, which is able to reduce the visibility of bends formed on an outer surface of a body that reduce the aesthetic sense of the product, and a refrigerator including the same.

More specifically, conventionally, attempts to reduce the surface gloss of a steel sheet to reduce the visibility of bends formed thereon have been made continuously. However, in all cases, the surface gloss targeted to be addressed is gloss of a front surface, that is, gloss at an angle of 60°. Also, in the conventional steel sheets, in all cases, in order to reduce the surface gloss, a matting agent is added only to an upper coating layer to reduce gloss. Although the visibility of bends is reduced with a decrease in the surface gloss of the steel sheet, a degree of reduction is not high, and the surface gloss is not fundamentally addressed.

The inventors of the present disclosure found that bends are not recognized well from a front surface and are recognized well from a side surface and confirmed that, as a result of measuring gloss of a steel sheet having bends formed thereon at different angles (20°, 60°, and 85°) using a glossmeter, the visibility of the bends decreased with a decrease in the gloss at 85°. In particular, the inventors confirmed that the visibility of the bends decreased to a desired level when the gloss at 85° was measured to be 10 GU or less. Also, the inventors confirmed that the visibility of the bends further decreased with a decrease in the gloss at 85° relative to the gloss at 60°.

Accordingly, the disclosed embodiment is directed to addressing a decrease in marketability by providing an exterior material for home appliances in which the gloss at 85°, which causes bends formed on the exterior material to be recognized, is decreased to reduce the visibility of the bends.

The exterior material 300 for home appliances may have a thickness of 0.4 mm or less.

The present disclosure is directed to reducing the amount of required raw materials by controlling the thickness of the exterior material to be small. To this end, a steel sheet with a high yield strength may be utilized, a coating layer may be formed thereon, and a depth of embossments may be optimized.

Next, a method of manufacturing an exterior material for home appliances according to another aspect of the present disclosure will be described in detail.

A method of manufacturing an exterior material for home appliances according to one embodiment includes: forming a base coating layer on a steel sheet, the base coating layer including 2.5 to 4.0 wt % of silica based on the entire weight of the base coating layer; forming a clear coating layer on the base coating layer, the clear coating layer including 2.0 to 5.0 wt % of beads and silica based on the entire weight of the clear coating layer; and forming embossments on a surface of the exterior material. Also, the embossments may have a depth of 70 to 90 μm.

The content of components of the coating layers and the depth of embossments are the same as those described above. Hereinafter, the method of manufacturing an exterior material for home appliances will be described in detail.

Figure 4:
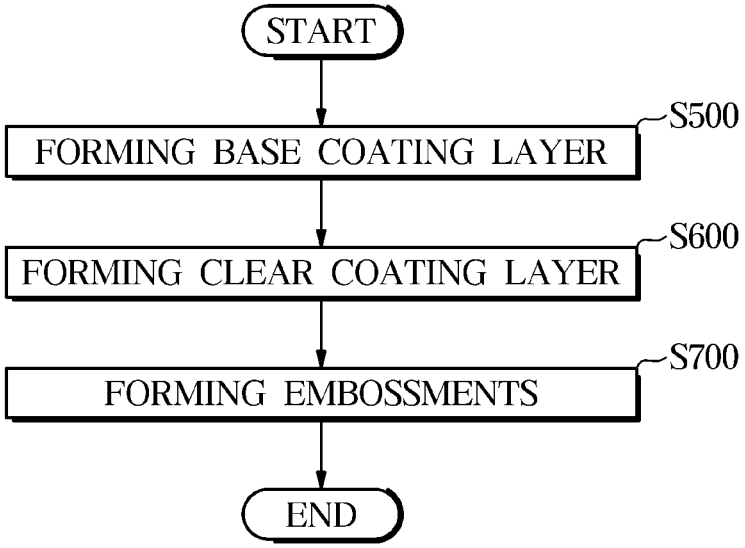
FIG. 4 is a flowchart illustrating a method of manufacturing an exterior material for home appliances according to one embodiment.

FIG. 4 is a flowchart illustrating the method of manufacturing an exterior material for home appliances according to one embodiment.

Referring to FIG. 4, the method of manufacturing an exterior material for home appliances according to one embodiment may include forming a base coating layer (500), forming a clear coating layer (600), and forming embossments (700).

First, a steel sheet 310 such as an electrolytic galvanized iron (EGI) steel sheet and a hot-dip galvanized iron (GI) steel sheet may be prepared, and then a base coating layer 320 may be formed on the steel sheet 310. The base coating layer 320 may include a polyester resin as the main resin and may include a leveling agent, a pigment, and the like. In addition to these components, the base coating layer 320 of an exterior material 300 for home appliances according to the disclosed embodiment may include a silica 324 as a matting agent.

The exterior material 300 for home appliances may be manufactured by a 2-coating 2-baking (2C-2B) method including baking after forming each coating layer. Alternatively, the exterior material 300 for home appliances may have a primer coating layer, the base coating layer 320, and a clear coating layer 330 provided on the steel sheet 310 and may be manufactured by a 3-coating 3-baking (3C-3B) method including baking after forming each coating layer. In the embodiment disclosed below, a steel sheet manufactured by the 2C-2B method will be described as an example.

The clear coating layer 330 may be provided on the base coating layer 320. The clear coating layer 330 may include a polyester resin as the main resin and may include a leveling agent or the like. In addition to these components, the clear coating layer 330 of the exterior material 300 for home appliances according to the disclosed embodiment may include beads 334 and a silica 332 as a matting agent.

In the forming of the embossments (700), embossments may be formed on a surface of the exterior material 300 for home appliances. In the forming of the embossments, embossments having a depth of 70 to 90 μm may be formed to reduce the visibility of bends formed on the surface of the exterior material 300.

The steel sheet 310 may have a yield strength of 350 to 410 MPa and may include 0.08 to 0.18 wt % of carbon based on the entire weight of the steel sheet.

Also, the bead 334 may have a size of 20 to 50 μm.

Next, a refrigerator according to another aspect of the present disclosure will be described in detail.

A refrigerator according to one embodiment includes: a cabinet provided at an outermost portion of the refrigerator; a cavity configured to form an inner wall of the refrigerator; and urethane provided between the cabinet and the cavity. The cabinet may include an exterior material for home appliances. The exterior material for home appliances may include: a steel sheet whose yield strength is 350 to 410 MPa; a base coating layer provided on the steel sheet; and a clear coating layer provided on the base coating layer. Also, a depth of embossments may be 70 to 90 μm.

The exterior material for home appliances is the same as the exterior material described above. Hereinafter, the refrigerator according to one embodiment will be described in detail.

Figure 5:
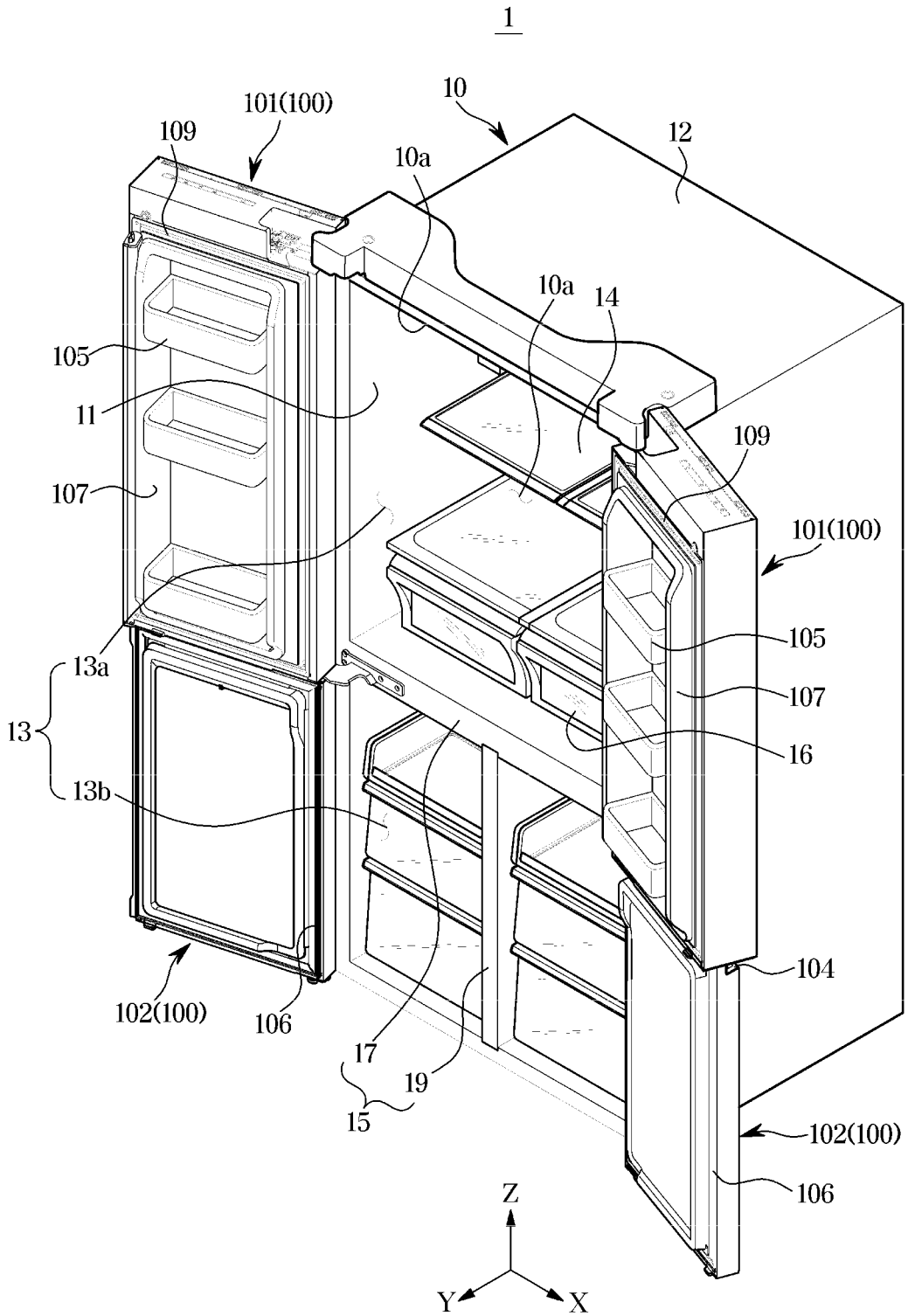
FIG. 5 is a perspective view of a refrigerator according to one embodiment.

FIG. 5 is a perspective view of the refrigerator according to one embodiment.

Referring to FIG. 5, a refrigerator 1 includes a body 10, a storage compartment 13 formed to be vertically divided inside the body 10, doors 100 configured to open and close the storage compartment 13, and a cold air supply device (not illustrated) configured to supply cold air to the storage compartment 13.

The body 10 may include a cavity 11 configured to form the storage compartment 13, a cabinet 12 coupled to an outer side of the cavity to form the exterior, and a body insulating material (not illustrated) formed by foaming between the cavity and the cabinet to insulate the storage compartment 13. The cabinet may be manufactured using a pre-coated metal (PCM) steel sheet 310.

The cold air supply device may generate cold air using a cooling circulation cycle in which a refrigerant is compressed, condensed, expanded, and evaporated.

The storage compartment 13 may be divided into a plurality of storage compartments by partitions 15, and a plurality of shelves 14 and storage containers 16 may be provided inside the storage compartment 13 to store food or the like.

The storage compartment 13 may be divided into a plurality of storage compartments 13*a* and 13*b* by the partitions 15, and the partitions 15 include a first partition 17 disposed in a horizontal direction to vertically divide the inside of the storage compartment 13 and a second partition 19 disposed in a vertical direction to horizontally divide the inside of the storage compartment 13.

The above division of the storage compartment 13 is only an example, and of course, the storage compartment 13 may be divided in a different manner from the above example.

The storage compartment 13 may be opened and closed by the doors 100. The doors 100 may include a pair of first doors (or upper doors) 101 configured to open and close an upper storage compartment 13*a* and a pair of second doors (or lower doors) 102 configured to open and close a lower storage compartment 13*b*.

The pair of first doors 101 and the pair of second doors 102 may open and close a body opening 10*a* of the open body 10. A handle may be provided at the first door 101 and the second door 102, and a user may use the handle provided at the first door 101 and the second door 102 to open the first door 101 and the second door 102.

A door shelf 105 configured to store food may be provided on a back surface of the first door 101. The door shelf 105 may include a shelf support 107 formed to vertically extend from the first door 101 to support the door shelf 105 from both left and right sides of the door shelf 105. The shelf support 107 may be detachably provided as a separate component at the first door 101. In the present embodiment, the shelf support 107 is provided to protrude rearward from the back surface of the first door 101 and extend in the vertical direction.

A first gasket 109 may be provided at an edge of the back surface of the first door 101 to seal a gap between the back surface of the first door 101 and the body 10 in a state in which the first door 101 is closed. The first gasket 109 may be installed in the form of a loop along the edge of the back surface of the first door 101 and may include a first magnet (not illustrated) therein.

The lower storage compartment 13*b* may be opened and closed by the second door 102 rotatably coupled to the body 10. A second gasket 106 may be provided at an edge of a back surface of the second door 102 to seal a gap between the back surface of the second door 102 and the body 10 in a state in which the second door 102 is closed. The second gasket 106 may be installed in the form of a loop along the edge of the back surface of the second door 102 and may include a second magnet (not illustrated) therein.

The steel sheet may include 0.08 to 0.18 wt % of carbon based on the entire weight of the steel sheet and may have elongation of 20% or higher.

The base coating layer may include 2.5 to 4.0 wt % of silica based on the entire weight of the base coating layer, the clear coating layer may include 2.0 to 5.0 wt % of beads and silica based on the entire weight of the clear coating layer, and the beads included in the clear coating layer may have a size of 20 to 50 μm.

The exterior material for home appliances may have gloss at 85° of 10 GU or less and a thickness of 0.4 mm or less.

Hereinafter, examples and comparative examples will be described to help understanding of the present disclosure. However, the following description only corresponds to one example of the content and advantageous effects of the present disclosure, and the scope of rights of the present disclosure and advantageous effects thereof are not necessarily limited thereto.

EXAMPLES

Samples of an exterior material for home appliances having configurations shown in Table 1 below were produced.

For each steel sheet sample, the yield strength was measured under a tensile speed of 20 mm/min using a tensile testing machine at room temperature, based on ASTM KS B 0802 standard.

The depth of embossments was measured by utilizing Mitutoyo's Digimatic Micrometer (MDC-25MXT) at room temperature.

TABLE 1

| | Whether side-surface reduction paint is used | Yield strength (MPa) | Depth of embossments (μm) |
|---|---|---|---|
| Comparative Example 1 | X | 250 | 50 |
| Comparative Example 2 | ○ | 380 | 60 |
| Example 1 | ○ | 380 | 70 |
| Example 2 | ○ | 380 | 80 |
| Example 3 | ○ | 380 | 90 |
| Comparative Example 3 | ○ | 380 | 100 |

Table 2 below shows glossiness, a degree of bends, and whether automatic conveying is possible.

The glossiness was measured at 60° and 85° at room temperature by utilizing BYK's Glossmeter, based on ASTM D523 and ASTM D2457.

The degree of bends was measured by performing urethane foaming on exterior materials to which the samples were applied, then 24 hours after the urethane foaming, imaging surfaces of the exterior materials using a 3D scanner. Here, an average height and standard deviation of the bends were measured, and then the standard deviation of 1.0 or less was evaluated to be good.

The imaging was performed by 3D scanning in which 3D measurement of the degree of bends was performed based on a laser robust to materials of the surfaces and the measured degree of bends were visualized through a bend visualization algorithm.

Whether automatic conveying is possible was determined to be defective in a case in which, when the sample was applied to an automatic conveying apparatus utilizing a rubber adsorption plate, the sample fell instead of being adsorbed onto the adsorption plate.

TABLE 2

| | Glossiness (GU) | | Degree of | Whether automatic conveying is |
|---|---|---|---|---|
| | 60° | 85° | bends | possible |
| Comparative Example 1 | 6.8 | 4.2 | Defective | Good |
| Comparative Example 2 | 4.6 | 2.8 | Defective | Good |
| Example 1 | 4.6 | 2.5 | Good | Good |
| Example 2 | 4.6 | 2.2 | Good | Good |
| Example 3 | 4.4 | 2.1 | Good | Good |
| Comparative Example 3 | 4.4 | 1.8 | Good | Defective |

Referring to Table 2, in Examples 1 to 3 in which the side-surface reduction paint was utilized, the yield strength of 350 to 410 MPa was satisfied, and the depth of embossments of 70 to 90 μm was satisfied, the glossiness at 85° was found to be low, and the degree of bends and whether automatic conveying is possible were both found to be good.

However, in Comparative Examples 1 and 2, the degree of bends was found to be defective due to a shallow depth of embossments. That is, the samples of Comparative Examples 1 and 2 were evaluated as having inferior surface quality.

In Comparative Example 3, whether automatic conveying is possible was found to be defective due to the depth of embossments being too deep, and thus productivity was evaluated to be low.

Figure 6:
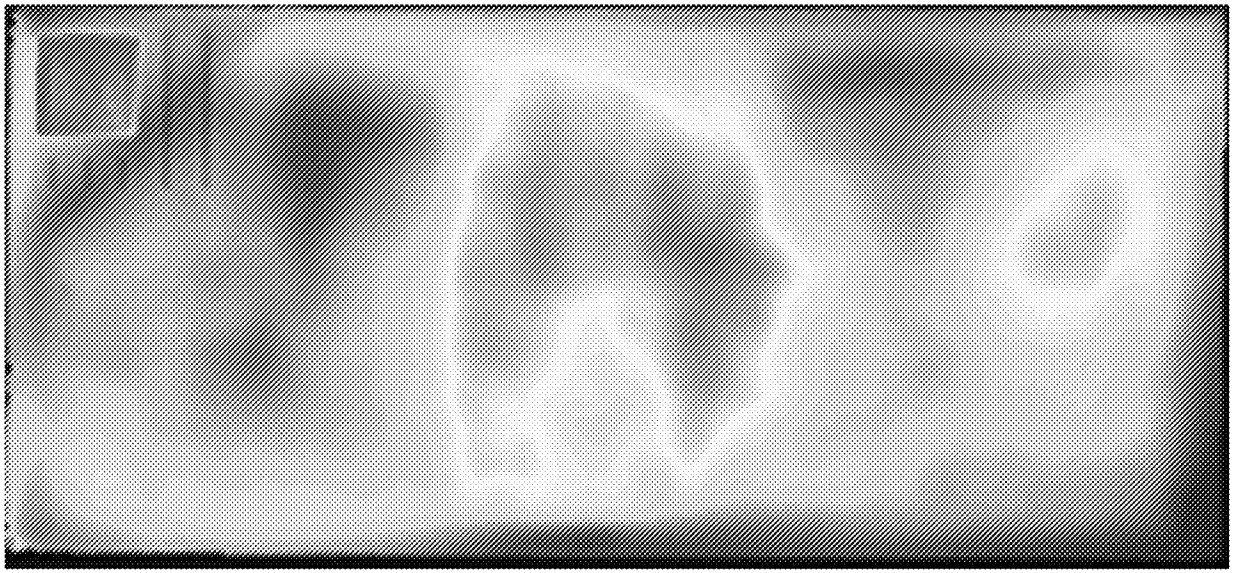
FIG. 6 is an image of a 3D scan of a degree of bends of Comparative Example 1 according to one embodiment.
Figure 7:
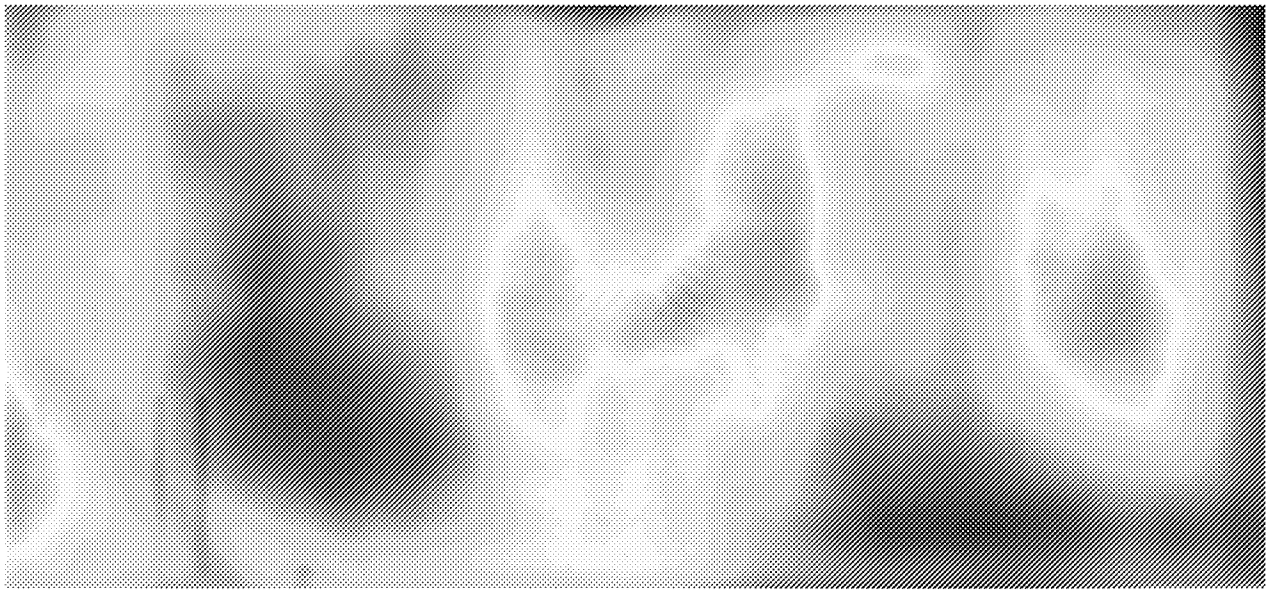
FIG. 7 is an image of a 3D scan of a degree of bends of Example 1 according to one embodiment.

FIG. 6 is an image of a 3D scan of the degree of bends of Comparative Example 1, and FIG. 7 is an image of a 3D scan of the degree of bends of Example 1. Here, a color closer to red indicates a higher degree of bends, and a color closer to blue indicates a more favorable degree of bends.

Referring to FIGS. 6 and 7, it can be seen that the degree of bends of Example 1 is more favorable than the degree of bends of Comparative Example 1.

Table 3 below shows a stiffness (N/mm) according to the depth of embossments for an exterior material for home appliances which utilizes a steel sheet utilizing the side-surface reduction paint and having the yield strength of 380 MPa.

The stiffness was obtained by measuring displacement when a vertical load of 800 N was applied for samples of the same area at room temperature. Here, the stiffness can be calculated by Equation (1) below.

$$\text{Stiffness (N/mm)} = \text{Load (N)} \times \text{Displacement (mm)} \qquad \text{Equation (1):}$$

TABLE 3

| | Depth of embossments (μm) | | | |
|---|---|---|---|---|
| | 40 | 60 | 80 | 100 |
| Stiffness (N/mm) | 88.43 | 89.22 | 90.39 | 90.51 |

Referring to Table 3, it can be seen that the stiffness increases with an increase in the depth of embossments. That is, since the stiffness of the exterior material increases with an increase in the depth of embossments, it can be confirmed that the resistance to bends is improved and the surface quality is enhanced with an increase in the depth of embossments.

According to one embodiment, it is possible to provide an exterior material for home appliances that utilizes a steel sheet configured to utilize special paint, optimize the depth of embossments, and have a high strength so that the surface quality is improved despite a small thickness, and a refrigerator including the same.

Specific embodiments illustrated in the drawings have been described above. However, the present disclosure is not limited to the embodiments described above, and those of ordinary skill in the art to which the disclosure pertains may make various changes thereto without departing from the gist of the technical spirit of the disclosure defined in the claims below.

What is claimed is:

1. An exterior material of a home appliance comprising:

a steel sheet having a yield strength of between 350 to 410 MPa;

a base coating layer on the steel sheet, the base coating layer including between 2.5 to 4.0 wt % of silica based on an entire weight of the base coating layer; and a clear coating layer on the base coating layer resulting in the exterior material, the clear coating layer including:

between 2.0 to 5.0 wt % of beads based on an entire weight of the clear coating layer, and 5 wt % silica based on an entire weight of the clear coating layer, the silica of the clear coating layer having a spherical shape, wherein a surface of the exterior material includes embossments that include bosses raised from an outer surface of the exterior material so that a depth between the bosses and the outer surface of the exterior material from which the bosses are raised is about 70 to 90 μm, and the exterior material has a gloss at 85° of 10 GU or less.

2. The exterior material of claim 1, wherein the steel sheet includes between 0.08 to 0.18 wt % of carbon based on an entire weight of the steel sheet.

3. The exterior material of claim 1, wherein the steel sheet has an elongation of 20% or higher.

4. The exterior material of claim 1, wherein beads are included in the clear coating layer and the beads have a size of 20 to 50 μm.

5. The exterior material of claim 1, wherein a thickness of the exterior material is 0.4 mm or less.

6. The exterior material of claim 1, wherein the gloss at 85° is 2.1 to 2.5 GU.

7. A method of manufacturing an exterior material for a home appliance, the method comprising:

forming a base coating layer on a steel sheet, the base coating layer including between 2.5 to 4.0 wt % of silica based on an entire weight of the base coating layer;

forming, on the base coating layer so as to form the exterior material, a clear coating layer including:

between 2.0 to 5.0 wt % of beads based on an entire weight of the clear coating layer, and 5 wt % silica based on an entire weight of the clear coating layer, the silica of the clear coating layer having a spherical shape; and forming embossments that include bosses raised from an outer surface of the exterior material such that a depth between the bosses and the outer surface of the exterior material from which the bosses are raised is about 70 to 90 μm and a gloss of the exterior material at 85° is 10 GU or less.

8. The method of claim 7, wherein the steel sheet has a yield strength of between 350 to 410 MPa.

9. The method of claim 7, wherein the steel sheet includes between 0.08 to 0.18 wt % of carbon based on an entire weight of the steel sheet.

10. The method of claim 7, wherein the beads have a size of 20 to 50 μm.

11. The method of claim 7, wherein the gloss at 85° is 2.1 to 2.5 GU.

12. A refrigerator comprising:

a cabinet at an outermost portion of the refrigerator;

a cavity forming an inner wall of the refrigerator; and urethane between the cabinet and the cavity, wherein the cabinet includes an exterior material including:

a steel sheet having a yield strength of between 350 to 410 MPa, a base coating layer on the steel sheet, the base coating layer including between 2.5 to 4.0 wt % of silica based on an entire weight of the base coating layer a clear coating layer on the base coating layer resulting in the exterior material, the clear coating layer including:

between 2.0 to 5.0 wt % of beads based on an entire weight of the clear coating layer, and 5 wt % silica based on an entire weight of the clear coating layer, the silica of the clear coating layer having a spherical shape, and a surface of the exterior material includes embossments that include bosses raised from an outer surface of the exterior material so that a depth between the bosses and the outer surface of the exterior material from which the bosses are raised is about 70 to 90 μm, and the exterior material has a gloss at 8520 of 10 GU or less.

13. The refrigerator of claim 12, wherein the steel sheet includes between 0.08 to 0.18 wt % of carbon based on an entire weight of the steel sheet.

14. The refrigerator of claim 12, wherein the steel sheet has an elongation of 20% or higher.

15. The refrigerator of claim 13, wherein the beads have a size of 20 to 50 μm.

16. The refrigerator of claim 12, wherein the gloss at 85° is 2.1 to 2.5 GU.

* * * * *